United States Patent [19]

Sprague, III

[11] 4,395,156

[45] Jul. 26, 1983

[54] SURFACE MATERIAL SPREADING

[76] Inventor: Henry W. Sprague, III, 21 Geneva Walk, Long Beach, Calif. 90803

[21] Appl. No.: 176,286

[22] Filed: Aug. 8, 1980

[51] Int. Cl.[3] ..... E01L 19/18

[52] U.S. Cl. ..... 404/110; 404/118; 37/270; 172/817

[58] Field of Search ..... 404/110, 108, 118, 101, 404/75; 172/817, 684.5; 37/41, 42 R, 42 VL, 270

[56] References Cited

U.S. PATENT DOCUMENTS

| | | | |
|---|---|---|---|
| 1,457,928 | 6/1923 | Johnson | 404/110 |
| 1,488,857 | 4/1924 | Arndt | 404/110 |
| 1,502,007 | 7/1924 | Arndt | 404/110 |
| 1,961,064 | 5/1934 | Miller | 404/110 |
| 2,662,313 | 12/1953 | Mowe et al. | 172/817 |
| 2,899,877 | 8/1959 | Phillips et al. | 404/110 |
| 2,914,995 | 12/1959 | Odell | 404/110 |
| 3,217,431 | 11/1965 | Heinzroth | 37/42 R |
| 3,526,173 | 9/1970 | Brandstetter | 404/118 X |
| 3,547,203 | 12/1970 | Jackoboice | 172/684.5 X |
| 3,800,447 | 4/1974 | Harvey | 172/817 X |

*Primary Examiner*—Nile C. Byers, Jr.
*Attorney, Agent, or Firm*—Grover A. Frater

[57] ABSTRACT

A particulate material spreader suitable for spreading asphalt on roadways and other paved surfaces is formed by a bucket which has a back and side walls but no bottom, and arms by which it may be carried at the rear of a vehicle and lifted or lowered by a hydraulic mechanism. Height adjusters at the sides of the bucket hold the lower edge of the back of the bucket at selected height above the roadway whereby a layer of asphalt is metered from the bottom of the bucket as the remainder of a pile of asphalt is raked away by the bucket.

16 Claims, 8 Drawing Figures

SURFACE MATERIAL SPREADING

TECHNICAL FIELD

This invention relates to methods and apparatus for spreading surfacing material, and, while not limited thereto, it relates to the spreading of asphalt on streets, highways, driveways, and parking lots.

BACKGROUND OF THE INVENTION

A primary use for the invention lies in resurfacing and repairing roadways and parking lots with hot asphaltic materials. The effects of the weather and traffic are to cause deterioriation and to create surface irregularities in paved surfaces. Hot asphalt repairs are made by spreading a quantity of hot asphalt or other particulate material on the damaged surface, followed by raking the repair material to fill holes and depressions while creating a smooth and level upper surface. It is usual to compact the repair material in place to seal it to the repaired surface and to provide a new surface which is smooth and resistant to weather damage. Most repair work of that kind is accomplished on roadways by employees or contractors of local governments.

Small holes are filled by hand, raked level, and the filling compacted with a heavy roller. It is hard work. It is messy and dirty, but it is effective if the repair material, when asphaltic, is used while hot and within a two-hour period beginning at the time the asphalt was produced. The two-hour time limit is a practical limiting factor for hot asphalt repairs. As the area of a road repair project is increased, logistical problems increase. These complexities increase costs and severely limit the area that can be repaired by the average patch repair crew.

Paving machines are available and they do an excellent job. They are costly, however, and must be moved from place to place with a trailer. Most of the available machines require a crew of six to nine workers. Fixed operating costs are so high that it is customary to employ two-way radio communication as a part of providing a continuous fresh supply of asphalt. Such machines are practical and necessary for the expeditious and economical accomplishment of long, continuous resurfacing tasks. They are entirely impractical for resurfacing short strips and patches which are spaced some on one street and others a few blocks away. It simply is too costly to employ six or nine people from one craft union and several from a trucking union to load and unload a machine costing tens or hundreds of thousands of dollars to effect medium sized repair jobs at a number of different locations.

The result, which can be verified in city after city from the largest metropolis to small villages, is that local governments make hand repairs until the repair jobs are too numerous or involve an area too large for the available manpower. Thereafter, no repair is made until the roadway has deterioriated to the point where the whold road, or much of it, requires resurfacing. At that point, a contract is let which will support use of a resurfacing machine and its related supporting industries.

That has been the procedure for years. Asphalt has been inexpensive. It has posed no special burden to resurface entire streets when their condition had deteriorated. But, asphalt uses large quantities of petroleum and costs have made it increasingly difficult to continue past practices.

SUMMARY OF THE INVENTION

It is an object of this invention to provide an improved method and apparatus for spreading particulate matter, including asphaltic materials.

It is an object to provide an improved method and means for effecting maintenance repair of streets, driveways, parking lots, walkways, and other areas that are covered with, or can be covered with, asphaltic or other particulate material.

A further object is to provide a repair method which increases the efficiency of small road repair crews and which requires less in manpower and equipment than has been available in machine made repairs. In that connection, it is an object to provide an apparatus which can be operated satisfactorily by unskilled local government laboring crews with less effort than is required in hand repair work and which is sufficiently low in cost to be feasible for local governments to own.

One of the specific objects of the invention is to provide an apparatus that will make it practical to repair streets that in past practice were not in poor enough shape to warrant use of a costly resurfacing machine.

These objects and other advantages of the invention which will become apparent upon an examination of the drawings and description that follows are achieved, in part, by the provision of a raking device and by mounting that raking device at the rear of a vehicle, preferably a truck, in which asphalt and other particulates can be carried and from which it is to be discharged to be acted upon by the rake. The raking device is mounted so that it can be lowered onto the surface to be repaired or lifted clear of the roadway when repairs are completed, allowing the vehicle to be driven normally. The mounting of the rake is such as to permit the vehicle to pull forward when the rake is lowered to road level and such that forward and reverse motion is possible when the rake is raised above the road level.

The rake provided by the invention is special in several senses. It can be fitted to conventional dump trucks that are, or can be, fitted with an hydraulic lifting mechanism of the kind that is commonly used to add a front end loading capability. That combination of truck and hydraulic lifter is standard equipment for many, if not most, county and city road maintainence organizations. The lifting mechanism can be used to mount an end loader, a road scraper, a snow plow, and other equipment on a truck—usually a dump truck. By providing an asphalt rake that can be mounted on and controlled by the same hydraulic lifter, the invention can be available to most road maintainence units by adding only the rake. To provide that advantage is another object of the invention.

Another requirement for practicality, and least cost for local government use, is that the invention require no special skill for its practice. Road repair is a relatively undesirable job. Turn over of workers is frequent. Often it is used as a summer employment opportunity for students. It is a feature and an object of this invention that almost no training is required as a condition to its successful practice. In this connection, the invention eliminates much of what is undesireable in road repair work, although it cannot cure summer heat or the unpleasant odor of hot asphalt.

THE DRAWINGS

DETAILED DESCRIPTION OF THE INVENTION

Figure 1:
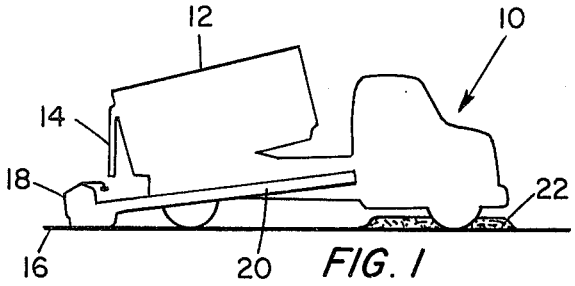
FIGS. 1 and 2 are schematic drawings which illustrate steps in practicing the method of the invention.

In FIG. 1, the dump truck 10 is shown with its dump container 12 lifted, and its end gate 14 open, so that asphalt or other particulate material will be discharged onto the roadway 16 just ahead of the spreader bucket 18 which is attached to the truck by a pair of arms one of which, 20, is visible. As the truck moves forward, drawing the spreader over the roadway, the asphalt is spread in the manner depicted in FIG. 4. Practice of the invention is not limited to this step of discharging asphalt onto the roadway as the truck is moving forward. Sometimes it is convenient simply to stop the truck, dump an appropriate quantity of asphalt onto the roadway, and then, after returning the truck to normal position, spreading the amount that has been discharged to the road. In other circumstances, a quantity of asphalt is piled along the roadway, over a portion of the area that is to be treated, and the truck drives forward over that material until it is engaged by the spreading apparatus and is spread over the entire area to be treated. Such a pile of material, in elongated form, is identified by the reference numeral 22 in FIG. 1.

After the asphalt, or other particulate material, has been spread, the road repairing process continues in accordance with past practice. Usually that includes pressing the asphalt down to seal it to the existing pavement and to provide a smooth upper surface. That task is accomplished with a power driven, heavy roller. The process might include hand raking to remove lumps at the edge of the patch to be treated, and any other step that is appropriate to the completion of a particular job.

Figure 2:
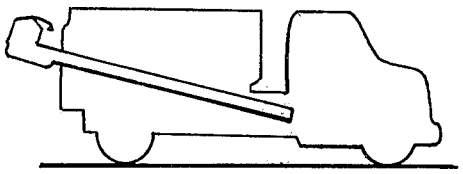

As for the truck and the spreader, they are free to move onto another job site down the road a few hundred feet or many miles away after no more preparation than to use the truck's hydraulic lifting mechanism to lift the arms and the bucket of the spreader from the roadway to a level where it is easily visible to the drivers of other vehicles. If the next job site is an appreciable distance away, it is a simple matter to lock the spreader in its transport position as illustrated in FIG. 2. That task requires only a minute or two and the truck can be off to the next job site, or to pick up a fresh load of asphalt.

Because asphalt must usually be spread and rolled within two hours of the time when first prepared, the mobility of the apparatus is very important and makes possible a new approach to road repairs.

Portability, no matter how convenient or desirable in itself, has little meaning unless the apparatus is capable of performing its function expeditiously and well. A preferred form of the apparatus of the invention is shown in FIGS. 3 and 5 through 8. It consists of relatively few components whose purpose and whose function is readily understood, at least in the degree necessary to enable totally unskilled workers to spread an appropriate quantity of asphalt at the required position and uniformly in the required thickness. In addition to the arm 20, the apparatus includes a similar arm 22 which is the mirror image of arm 20. At their forward ends, the arms are connected to an hydraulic lifting apparatus. That apparatus is an accessory for trucks which is available in a number of different specific structural forms. The form illustrated is representative.

Figure 3:
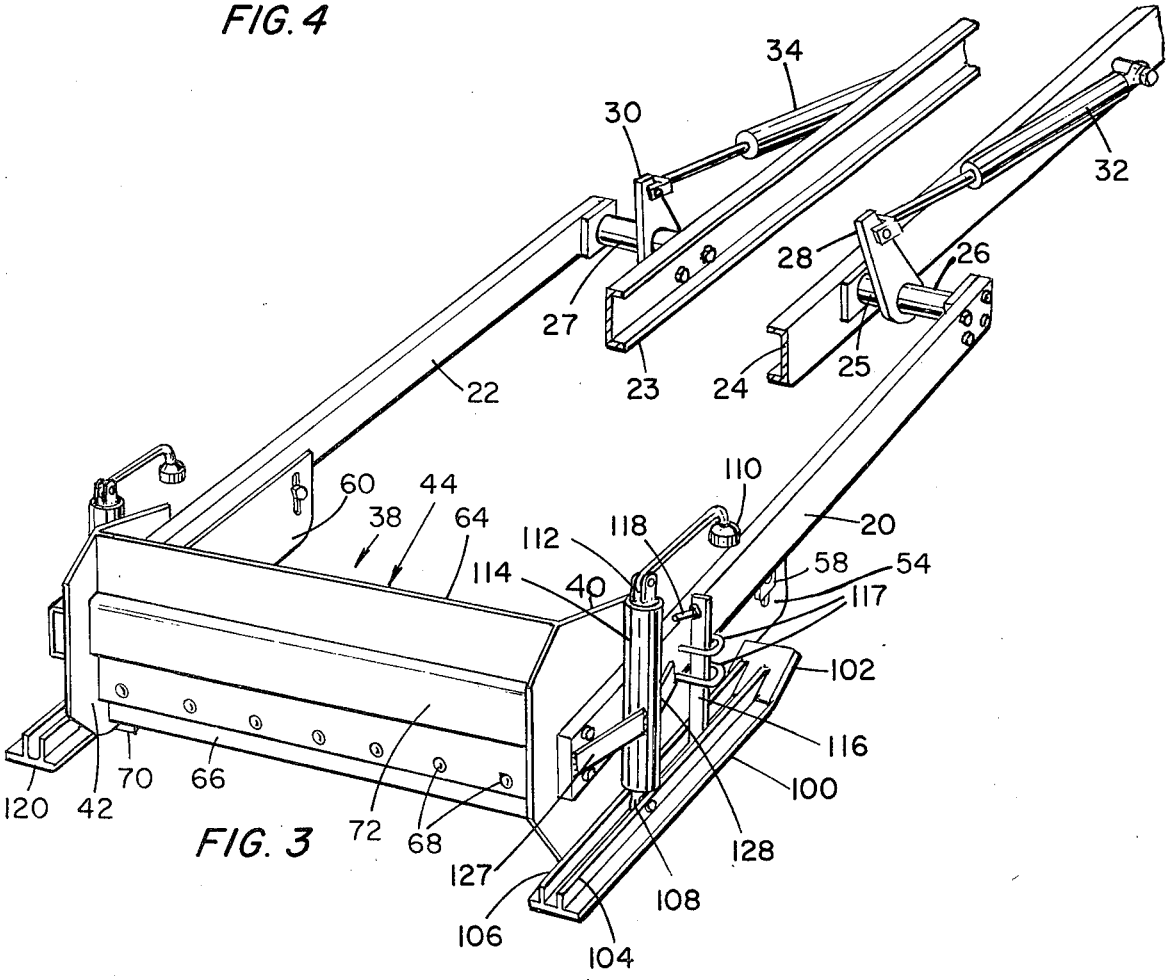
FIG. 3 is a perspective drawing, partially fragmented and partially exploded, of a rake in which the invention is embodied, and which is connected to an hydraulic mechanism.

A trunnion is bolted to the outer surface of each of the two longitudinal truck frame members 23 and 24. They are usually positioned just at the rear of the truck cab. An associated one of two oscillating sleeves fits over each of the trunnions. Each sleeve is bolted to an associated one of the two arms which extend in parallel, one on each side of the truck. A lever arm is fixed to each sleeve at a point close to the frame member and an hydraulic piston is connected between the lever arm and the side of a frame member. In FIG. 3, the trunnion 25 of frame member 24 is visible. Both oscillating sleeves 26 and 27 are visible. The lever arm 28 is fixed to sleeve 26 and lever arm 30 is fixed to sleeve 27. The two hydraulic cylinder assemblies are designated 32 and 34. Their pistons are connected to lever arms 28 and 30, respectively, and their cylinders are connected to frame members 24 and 23, respectively. In the case of frame member 24, the cylinder of assembly 32 is connected to a bracket 36 which is bolted to the outer side of the frame member.

In this case, the cylinder assemblies extend toward the front of the truck. If more convenient in a particular case, they can be arranged to extend toward the rear of the truck. Also, the lever arms may extend downwardly instead of upwardly. Because of these alternatives, and because the trunnions can be mounted at a convenient point along the frame members, this preferred mounting arrangement is applicable to a wide variety of truck brands and models.

Whether it be this lifting structure, or another, some means to perform the function of rotating the arms 20 and 22 is required in the practice of the preferred method of the invention.

At their outer ends, the arms 20 and 22 are connected to respectively associated opposite sides of a bucket generally designated 38. Among its major components are a pair of end plates 40 and 42, respectively. The end plates are spaced apart, and the distance between them is spanned by a back plate 44. The bucket has no top wall and it has no bottom wall. In assembled condition, it is disposed between the rearward ends of the arms 20 and 22. The end plate 40 is bolted to arm 20, and the plate 42 is bolted to arm 22. In this embodiment there are four bolts. They are arranged in two pairs.

The bucket includes a bucket extension member 54. That member is bolted to the end plate 40 at its rearward end by a bolt whose head is not visible in FIG. 3. At its forward end the bucket extension 54 is bolted to a tab 58 which is welded and extends downwardly from the lower edge of the arm 20. The mounting bolts for that forward extension extend through elongated openings in the bucket extension, and that feature permits adjustment of the position of the bucket extension in the vertical plane. Except that they are all formed as mirror images of the elements on the right side of the structure, the elements at the left side, the arm 22, the end plate 42, the bucket extension 60, and the several bolts at the left side, are assembled in the same fashion as are the corresponding elements on the right side.

The back plate 44 serves as a means for pushing a quantity of asphaltic material forwardly as the bucket is pulled by a truck, and it serves, also, as the means by which a layer of asphaltic material is metered out to selected and uniform height above the level of existing roadway. That latter function is performed by a rake element which forms part of the back plate. The pusher plate 64 is a broad, flat plate whose upper edge in this embodiment extends to the highest point of the end plates and which, when the bucket is lowered to the roadway, extends at least eighteen inches above the road surface. The rake 66 is a separate bar which is bolted by a series of bolts to the lower margin of the pusher plate 64. Some of those bolts have been identified with the reference numeral 68 in FIG. 3. The rake will be described more completely later. At its edges, the rake is protected by a small plate that is secured, as by welding, on edge to the end plate. That small plate is spaced from the pusher plate by a distance that exceeds the width of the rake bar only slightly. One of those small plates is visible in FIG. 3 where it has been identified with the reference numeral 70. The corresponding plate, on the other side, is fixed to end plate 40 but is not visible in the perspective view of FIG. 3. Like those small protective plates, the pusher plate has a fixed connection, as by welding, to the end plates 40 and 42, in the preferred embodiment. The structure that is designated 72 in FIG. 3 is a fabricated reinforcement structure whose purpose is to prevent bending and buckling of the back plate as it is pulled forward to push a quantity of asphaltic material before it.

Figure 4:
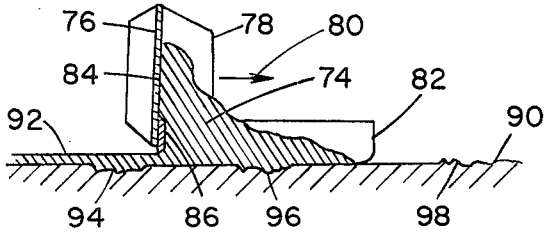
FIG. 4 is a diagram illustrating how the rake performs its function.

The diagram of FIG. 4 illustrates how that is done. In FIG. 4, a pile 74 of asphaltic material is being pushed forward by the back plate 42 of the bucket which includes an end plate 42. The arrow 80 indicates that the bucket is being moved to the right in FIG. 4. The extension 60 serves to prevent portions of the asphalt pile from being pushed to the side out of the path of the bucket back plate 44. The back plate 44 includes a pusher portion 64 and a rake portion 66 which is fixed to and extends down from a lower margin of the pusher plate 84. However, while the bucket extension 82 is lowered so that its lower edge just clears the roadway, the lower edge of the rake is lifted somewhat so that a layer of asphalt remains atop the roadway 90 as the body of asphaltic material is moved to the right. The layer of material that remains on the roadway is numbered 92 for identification. Its upper surface is parallel with the upper surface of the roadway, and it forms a layer of asphaltic material which has uniform thickness except in those regions where the roadway is defective in that it is formed with depressions and potholes. One of the potholes is identified by the reference numeral 94. It has been filled with asphaltic material just as the pothole 96 is filled. Each pothole, in turn, is filled as the pile 74 of asphaltic material is pushed over it. It is not the rake 86 that fills the pothole. The function of the rake is to spread the asphaltic material in a layer, like a butter knife. The pothole is filled with asphaltic material when the pile of material is moved over it. The weight of the body of the material serves to ensure that enough material is forced down into the depression or pothole so that it will be completely filled.

Ahead of the bucket is a place in the roadway where the surface is undulated or corrugated. That place is identified with the numeral 98. If the side extensions of the bucket straddle that position, the depressions will be filled with asphalt as the bucket passes over it, and the rake 86 will spread the material at uniform height unless the undulations reach to greater height. In that case, unless they are excessive, the protrusion will be shaved off by the lower edge of the rake.

The lower edge of the rake 86 is held at proper height above the roadway by a pair of skids, one mounted at each end of the bucket and each fitted with a means by which its respectively associated end of the bucket may be raised or lowered relative to the surface of the roadway. Except that the two skids are mirror images one of the other, they are the same, and they can be understood by examining the skid 46 in FIG. 3. The skid includes a lower plate 100 which is dragged over the surface of the road as the spreader is pulled forwardly by the truck. The forward end 102 of that bottom plate is bent upwardly at an angle to ensure that the plate will not become caught at the edge of a pothole or deterred from its movement by some other obstruction. A pair of bars 104 and 106 are arranged in parallel and have their lower margins fixed by any convenient means, as by welding, to the upper surface of plate 100. These two bars are spaced so that they will receive between them the lower end 108 of a jack assembly 109 which is operated by rotation of a handle 110. The handle is mounted pivotally on the top element 112 of the jack. While shown with its hand knob down, the handle is swung around so that the knob is upward when it is desired to operate the jack. It is operated by rotating the handle around the vertical axis of the jack, and that action serves to cause an extension of the jack in which the upper portion 114 is moved relative to the lower portion 108 to carry the arm 20 to a different distance from the lower edge of the plate 100. When the arm is lowered to lower the spreader to road level, the plate 100 rests upon the ground to limit the degree in which the arms can be lowered. At that point, pressure in the lift cylinders is relieved so that the weight of the spreader is transferred to skid 46 and the corresponding skid 120 at the opposite side of the spreader. By rotating the jack handle an operator can lift and lower the spreader bucket relative to the roadway, and that action changes and adjusts the separation between the lower edge of the rake 66 and the level of the roadway. The jack assembly at the other side of the structure is numbered 123.

To ensure against loss of the lower part of the skid in the event that the jack parts become separated, and to keep the skid properly oriented in other cases, a simple guide mechanism is employed. A bar 116 has its lower end pivotally connected to the parallel bars 10. It extends upwardly through a pair of U-bolts which are fixed to the outer side of arm 20. The U-bolts are identified by the numeral 117. A pin 118 projects from bar 116 to prevent the bar from becoming separated from the U-bolts. The corresponding bar 150 and pin 151 at the other side of the bucket are visible in FIGS. 7 and 8.

In practice, the layer of asphaltic material that is spread on the roadway will vary from one-eighth of an inch in thickness to one inch or a little more than one inch. To prevent the emergence of asphaltic material at the side of the spreader under the bucket extensions, the latter are made independently adjustable. The mounting bolts are loosened and the side extension is lowered so that it just clears the roadway. When the extensions are in that position, the bolts are retightened.

Figure 6:
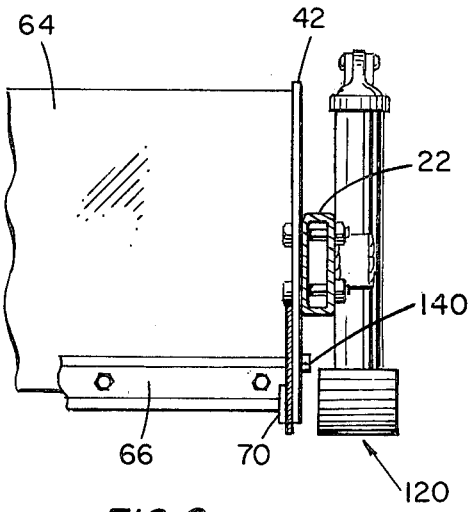
FIG. 6 is a view in elevation of a fragment on the left side of the rake of FIGS. 3 and 5 as seen from the front.
Figure 7:
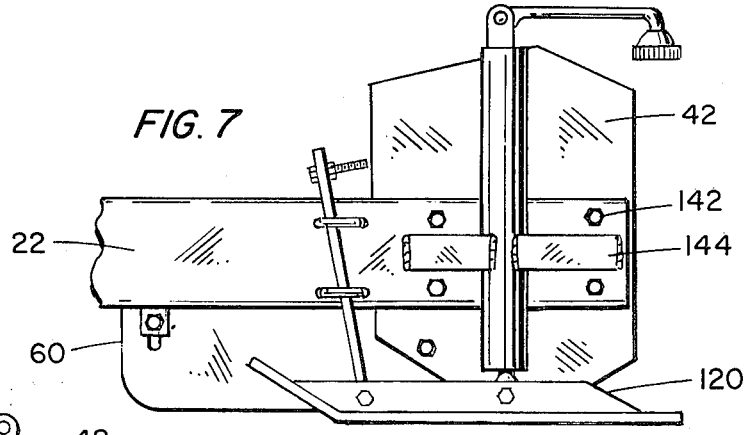
FIG. 7 is a view in side elevation of a fragment of the left side of said rake.
Figure 8:
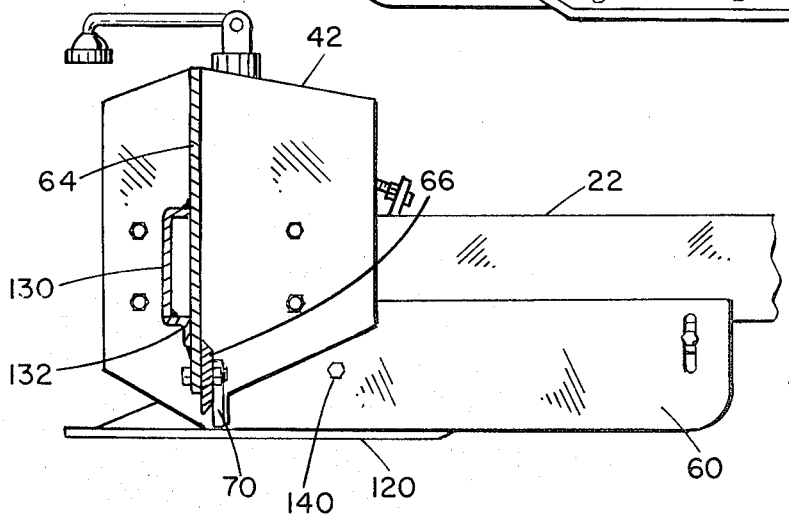
FIG. 8 is a cross-sectional view taken on line 8—8 of FIG. 3 of the right rear portion of said rake.

In this embodiment, the upper jack section 114 is attached to the arm 20 by two plates 127 and 128 which are welded both to the jack section and to the arm, one forwardly and the other rearwardly, from the jack. That the structure at the opposite side of the spreader is the same will be apparent from an examination of FIGS. 5, 6, 7 and 8, all of which show the construction of the spreader at the left side of the bucket. The bucket and skid are shown from the rear in FIG. 5. The small protective plate 70 extends down slightly below the lower edge of rake 66. That separation represents the minimum thickness which the rake 66 can spread. As previously described, the rake is bolted to the lower end of the pusher plate 64. The arrangement of those elements is best seen in FIG. 8 which shows that the lower edge of the rake is tapered in cross-section so that the lower edge becomes quite thin. That feature aids greatly in ensuring that the material being spread is metered to a uniform height above the roadway. No more is required than to provide that shape. A uniform layer results whether the rake is moved rapidly or slowly, and it results whether the rake is moved continuously or whether it is stopped and started during the course of accomplishing the job. The effect is that the workers who participate in the job need have no special knowledge or talent other than what is required to select the desired layer height and to drive the truck and to operate the hydraulic lift mechanism. As best shown in FIGS. 6 and 8, both edges of the rake are tapered. Tapering of the upper edge means that no ledge remains on which asphaltic material can collect. However, the reason for tapering both edges is so that if one edge becomes damaged in the field, it is possible to correct that situation simply by unfastening the rake and turning it over end-to-end and reassembling it with the pusher plate.

Figure 5:
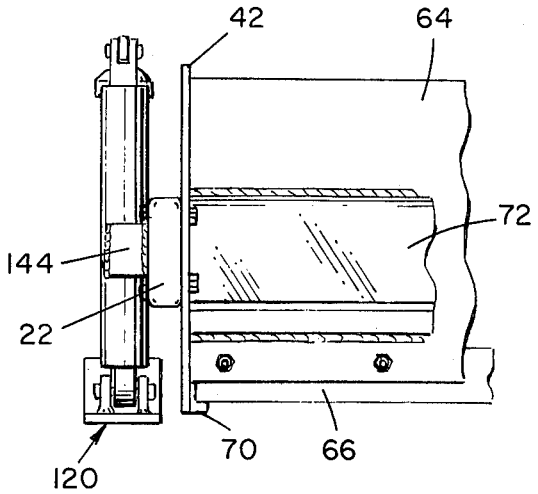
FIG. 5 is a view in elevation of a fragment of the left side of the rake of FIG. 3 as seen from the rear.

A comparison of FIGS. 5 and 8 show that the reinforcing structure 72 is formed by two L-shaped pieces, one designated 130 and the other designated 132. In the preferred form of the invention, they are welded one to the other, and both to the pusher plate. In FIGS. 7 and 8, it can be seen that the bucket extension member 60 lies adjacent to the end plate 42 inboard of the lift arm 22. The lift arm is sectioned in FIG. 6, at a point rearwardly of the point of interconnection of the lift arm and the bucket extension. Because of that, the bolt 140 that interconnects the extension and the end plate 42 is visible. Also, the retention bar 150 and U-bolts 152, which are shown in FIG. 7, have been omitted from FIG. 6 for the sake of clarity.

It will be apparent from the description above that the invention provides a structure that is especially useful in practicing the method of the invention. No only are the bucket, rake and skid elements suited to doing an excellent job of spreading asphalt using the power of the pulling truck, those same elements require no adjustment or change when the unit is to be moved and used at some other place. No more is required than to mount the unit on a truck and then to lift the lower it as it is moved from one repair site to another.

Although I have shown and described certain specific embodiments of my invention, I am fully aware that many modifications thereof are possible. My invention, therefore, is not to be restricted except insofar as is necessitated by the prior art.

I claim:

1. The method of spreading asphaltic materials using a truck equipped with an hydraulic lift and a rake fixed to side skids and mounted at the rear of the truck on said lift which method comprises the steps of:

depositing a quantity of asphaltic material in said track;

carrying said quantity of asphaltic material to a job site where said material is to be spread over a given area while holding said rake above the road;

lowering said rake and side skids to the road such that the rake rests at a selected level above the level of the road at the sides of said given area and utilizing the weight of said skids to maintain the rake at said selected level;

depositing a quantity of said asphaltic material at one end of said given area ahead of said rake in the direction of forward motion of said truck;

raking said asphaltic material by pulling the rake, using the truck, in the direction to pull the rake toward said quantity of asphalt and over said given area;

after having traversed said given area, lifing the rake from the roadway; and while the rake is held lifted, driving the truck to a point at which the truck and rake are clear of said given area.

2. The invention defined in claim 1 in which the step of raking is accomplished by pushing on said quantity of asphaltic material to force it to be distributed across the width of the area on which the material is to be spread; and pulling the quantity of asphalt, after having been as distributed, in the direction to traverse said given area while permitting material to escape from the rake to a selected depth.

3. A particulate material spreader rake for use with a vehicle already fitted with an attachment lifter or new hydraulic or lifter mechanism in incorporated and capable of pulling it and a pile of particulate material when the spreader rake is disposed at the rear of said vehicle and is mounted on said lifter, said spreader rake comprising:

a bucket formed by a transverse back plate and side plates;

means for attaching said bucket to an attachment lifter such that the back plate is held in a substantially vertical plane transverse to the direction in which it is to be pulled; and height selection means for holding said transverse plate at a selected minimum height above a roadway independently of the action of said lifting means but held down by side arm hydraulic force.

4. The invention defined in claim 3 in which said back plate includes a rake element which extends over the width of the back plate and one edge of which forms the lower edge of said back plate, the lower edge of said rake element being tapered throughout its length in cross-section to narrower thickness in the downward direction.

5. The invention defined in claim 4 in which said height selection means for holding said transverse plate at a selected height comprises means engageable with the road for holding the ends of said lower edge of said rake element at selected height.

6. The invention defined in claim 5 in which said height selection means comprises a pair of structures, one on each side of said bucket, respectively, fixed to said bucket and including means for engaging a roadway while holding the proximate end of said rake element such that its lower edge is held at a respectively selected distance above said road.

7. The invention defined in claim 3 in which said attachment means comprises a pair of arms, extending substantially in parallel one to the other, each fixed at a first end thereof to a respectively associated one of said end plates.

8. The invention defined in claim 7 in which said arms are fixed at the opposite ends thereof to said lifter for rotation together to carry said bucket upward from a position adjacent to the roadway on which the vehicle rests to a point near the upper rear of the vehicle.

9. The invention defined in claim 7 which further comprises a pair of bucket extensions carried one on each end of said bucket and extending parallel with said arms respectively, and downwardly therefrom, and forward from said end plates.

10. The invention defined in claim 9 which further comprises means for adjusting the height of the lower edge of each of said bucket extensions above the roadway relative to the position of said transverse plate above said roadway.

11. A particulated material spreader rake for use with a vehicle already fitted with an attachment lifter capable of pulling it and a pile of particulate material when the spreader rake is disposed at the rear of said vehicle and is mounted on said lifter, said spreader rake comprising:

a bucket formed by a transverse back plate and side plates;

means for attaching said bucket to an attachment lifter such that the back plate is held in a substantially vertical plane transverse to the direction in which it is to be pulled; and height selection means for holding said transverse plate at a selected height above a roadway independently of the action of said lifting means but held down by side arm hydraulic force;

said attachment means comprising a pair of arms, extending substantially in parallel one to the other, each fixed at a first end thereof to a respectively associated one of said end plates;

a pair of bucket extensions carried one on each end of said bucket and extending parallel with said arms respectively, and downwardly therefrom, and forward from said end plates;

means for adjusting the height of the lower edge of each of said bucket extensions above the roadway relative to the position of said transverse plate above said roadway; and said height selection means comprising two height selection structures one at each end of said bucket and each comprising a skid plate and an attachment plate fixed to a respectively associated end of the bucket and a jack having one of its parts connected to the skid plate and the other of its parts connected to the attachment plate.

12. A particulate material spreader rake for use with a vehicle already fitted with an attachment lifter capable of pulling it and a pile of particulate material when the spreader rake is disposed at the rear of said vehicle and is mounted on said lifter, said spreader rake comprising:

a bucket formed by a transverse back plate and side plates;

means for attaching said bucket to an attachment lifter such that the back plate is held in a substantially vertical plane transverse to the direction in which it is to be pulled; and height selection means for holding said transverse plate at a selected height above a roadway independently of the action of said lifting means but held down by side arm hydraulic force;

said attachment means comprising a pair of arms, extending substantially in parallel one to the other, each fixed at a first end thereof to a respectively associated one of said end plates;

a pair of bucket extensions carried one on each end of said bucket and extending parallel with said arms respectively, and downwardly therefrom, and forward from said end plates;

means for adjusting the height of the lower edge of each of said bucket extensions above the roadway relative to the position of said transverse plate above said roadway; and said end plates lying in parallel planes perpendicular to the plane of said transverse plate, said arms being fixed to respectively associated ones of said end plates at the outer opposite said transverse plate;

said means for adjusting height comprising two independently acting structures each fixed to a respectively associated one of said arms adjacent to, and at the side of the arm opposite from, the end plate associated with said one arm whereby said arms lie outside the width of the bucket and the height adjusting structures lie outside the width of the arms.

13. The invention defined in claim 12 in which said transverse back plate comprises a means in the form of the upper portions of the back plate for pushing a pile of asphalt before the plate as the plate is moved;

said back plate further comprising rake means for permitting a layer of asphalt to remain on a roadway as the bucket is drawn thereover, said rake means forming the lower margin of said transverse back plate.

14. The invention defined in claim 13 in which said rake means is tapered in cross-section, throughout its length, to a lesser thickness in the downward direction.

15. The invention defined in claim 14 in which said bucket extensions are disposed one on each side of the bucket, between its respectively associated arm and end plate and which comprises means for fixing said bucket extensions to the buckets and arms at a selected height relative to the height of said back plate.

16. The invention defined in claim 15 in which said height selection means comprises two height selection structures one at each end of said bucket and each comprising a skid plate and an attachment plate fixed to a respectively associated end of the bucket and a jack having one of its parts connected to the skid plate and the other of its parts connected to the attachment plate.

* * * * *